United States Patent [19]

Nishimiya et al.

[11] 4,110,978

[45] Sep. 5, 1978

[54] APPARATUS FOR PURIFYING EXHAUST GAS

[75] Inventors: Torazō Nishimiya, Mito; Yoshishige Ōyama, Katsuta; Ryoichiro Oshima, Hitachi, all of Japan

[73] Assignee: Hitachi, Ltd., Japan

[21] Appl. No.: 745,999

[22] Filed: Nov. 30, 1976

[30] Foreign Application Priority Data

Dec. 5, 1975 [JP] Japan ..... 50-144006

[51] Int. Cl.[2] ..... F02D 75/10; F07D 35/00; F02M 7/00

[52] U.S. Cl. ..... 60/276; 60/301; 123/119 D; 123/119 EC; 123/124 R

[58] Field of Search ..... 123/119 EC, 119 D, 119 DB, 123/97 B, 124 R, 124 A, 124 B; 60/276, 301

[56] References Cited

U.S. PATENT DOCUMENTS

| | | | |
|---|---|---|---|
| 3,287,899 | 11/1966 | Bintz | 60/301 X |
| 3,824,788 | 7/1974 | Cole et al. | 60/301 X |
| 4,036,186 | 7/1977 | Hattori et al. | 123/124 R |
| 4,057,042 | 11/1977 | Aono | 60/276 |

*Primary Examiner*—Wendell E. Burns
*Attorney, Agent, or Firm*—Craig & Antonelli

[57] ABSTRACT

An apparatus for purifying an exhaust gas on the basis of a single three-functional catalyst capable of oxidizing hydrocarbons and carbon monoxide, and simultaneously reducing nitrogen oxides, where a fuel-controlling means is provided for dividing driving conditions into an accelerating stage as zone I, a steady running stage as zone II, and a slowing-down and idling stage as zone III, and controlling an air-fuel mixture to be fed from a carburetor to a reducing state of the three-functional catalyst in zone I, a three-functional state in zone II, and an oxidizing state in zone III.

3 Claims, 9 Drawing Figures

APPARATUS FOR PURIFYING EXHAUST GAS

BACKGROUND OF THE INVENTION

The present invention relates to an apparatus for purifying an exhaust gas from automobiles using gasoline engines.

Generally, gaseous pollutants discharged from automobiles are carbon monoxide (CO) and hydrocarbons (HC) due to incomplete combustion, and nitrogen oxides (NOx) formed by thermal dissociation depending upon a combustion temperature. These three pollutants each require contacting means for their purification on account of different generating mechanisms, and it is very difficult to abate these three pollutants at the same time. The simultaneous abatement also gives a considerable adverse effect upon driving performance, fuel cost, etc.

Under these circumstances, an apparatus using a single three-functional catalyst capable of oxidizing CO and HC and simultaneously reducing $NO_x$ has been so far regarded as important. The three-functional catalyst can have purification ratios each of CO and HC, and $NO_x$ of more than 90% approximately at the theoretical air-fuel ratio of 14.5. Therefore, if the air-fuel ratio of an air-fuel mixture to be supplied from a carburetor is controlled approximately to the theoretical air-fuel ratio under every driving conditions, all the gaseous pollutants can be purified at purification ratios of more than 90%.

A process has been proposed, as disclosed in U.S. Pat. No. 3,942,493, which comprises providing an oxygen concentration detector (the so-called $O_2$ sensor) in an exhaust gas line to detect an oxygen concentration of the exhaust gas, and transmitting an output of the $O_2$ sensor to an electromagnetic valve provided in an air bleed of carburetor through an amplification control means, thereby changing a flow rate of air passing through the air bleed and making an air-fuel mixture supplied from the carburetor approach the theoretical air-fuel ratio. However, the prior art process has several problems. For example, it is very difficult to control an air-fuel ratio of the air-fuel mixture supplied from the carburetor to a narrow range around the theoretical air-fuel ratio in every driving conditions, and a considerable increase in cost is inevitable for the control. Furthermore, a high precision sensor is necessary for exactly controlling the air-fuel ratio, but the currently available $O_2$ sensors still have such problems as unevenness in product quality lots by lots, unevenness in their performances depending upon driving states, durability, reliability, etc.

SUMMARY OF THE INVENTION

An object of the present invention is to provide an apparatus for purifying an exhaust gas in high purification ratio, based on a three-functional catalyst, by a simplified fuel-controlling means without using any $O_2$ sensor.

Another object of the present invention is to provide an apparatus for purifying an exhaust gas in high purification ratio, based on a three-functional catalyst, by a fuel-controlling means with an $O_2$ sensor with less precision, when the sensor is used.

The present invention provides an apparatus for purifying an exhaust gas, on the basis of simple three-functional catalyst capable of oxidizing HC and CO, and simultaneously reducing $NO_x$, which comprises a fuel controlling means for dividing driving conditions into an accelerating stage as zone I, a steady running stage as zone II, and a slowing-down and idling stage as zone III, and controlling an air-fuel mixture to be fed from a carburetor to a reducing state of the three-functional catalyst in zone I, a three-functional state in zone II, and an oxidizing state in zone III.

EMBODIMENTS OF THE INVENTION

The present invention will be described in detail, referring to the accompanying drawings.

Figure 1:
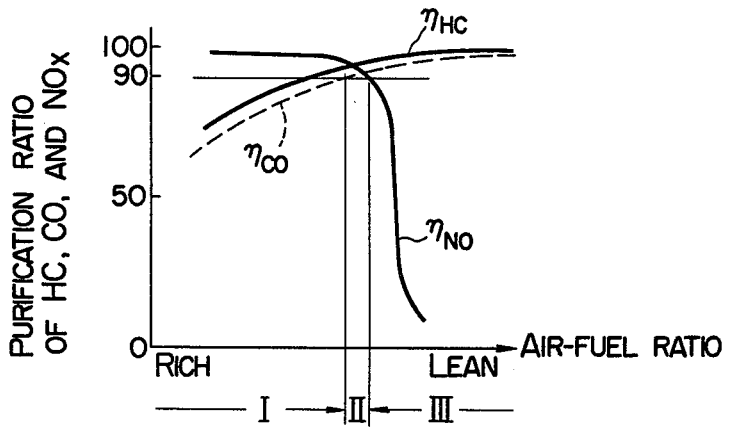
FIG. 1 is a characteristic diagram of a three-functional catalyst showing relations between air-fuel ratio and purification ratios of hydrocarbons (HC), carbon monoxide (CO), and nitrogen oxides ($NO_x$).

In FIG. 1, relations between air-fuel ratio and purification ratios of CO, HC, and $NO_x$ in a three-functional catalyst are shown. In zone I a reducing state prevails, where purification ratio of HC and CO are lowered, but purification ratio of $NO_x$ is near 100%. In zone II, a three-functional state prevails, where purification ratios of HC, CO, and $NO_x$ each are about 90%, and in zone III an oxidizing state prevails, where purification ratio of $NO_x$ is lowered, but on the contrary purification ratios of HC and CO are near 100%.

The present invention utilizes these characteristics of the three-functional catalyst by making said zone I prevail at accelerating stage, said zone II at steady running stage, and said zone III at slowing-down and idling stage. At the accelerating stage of zone I, generation of $NO_x$ is larger, and the three-functional catalyst is brought into the reducing state to make the purification ratio of $NO_x$ approach 100% to give the purification of $NO_x$ a preference. In that case, the purification ratios of HC and CO are lowered to about 60 to 70%, but exhaust gas temperature is elevated at the accelerating stage, so that the oxidizing action is not so much deteriorated.

At the steady running stage of zone II, an air-fuel mixture having approximately the theoretical air-fuel ratio is supplied to make all three purification ratios of $NO_x$, CO and HC exceed 90%.

At the slowing-down and idling stage of zone III, $NO_x$ is hardly generated, and thus it is not necessary to make control to the zone II of approximately theoretical air-fuel ratio for making the purification ratio of $NO_x$ exceed 90%, but only necessary to make an oxidizing state in zone III to give the oxidation of HC and CO a preference.

An embodiment of the present invention on the basis of said control concept will be described in detail below.

Figure 2:
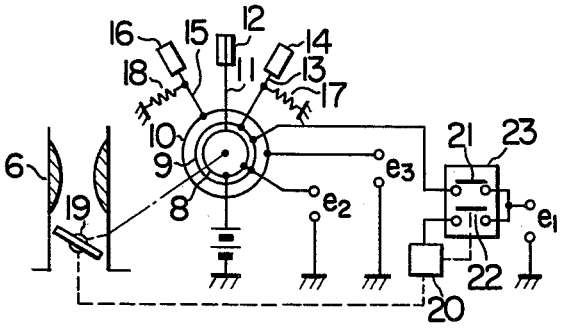
FIGS. 2, 3A, 3B, 3C, and 4 show structures of an apparatus for purifying an exhaust gas, embodying the present invention.

In FIG. 2, a structure using no $O_2$ sensor is illustrated. Shaft 8, shaft 9 and shaft 10 are arranged concentrically and constructed to function independently. Contact 12 is provided on shaft 8 through lever 11, contact 14 on shaft 9 through lever 13, and contact 16 on shaft 10 through lever 15. Spring 17 is provided on lever 13, and spring 18 on lever 15.

Furthermore, shaft 8 is mechanically connected to throttle valve shaft 19 of carburetor 6. Output terminals are provided at the respective contacts and an output from contact 14 is taken up through OR circuit 23 comprising contact 21 and contact 22 of throttle valve closure-detecting mechanism 20 through throttle valve shaft 19, and slowing-down is distinguished from idling thereby. The slowing-down is detected by contact 21 in a closed circuit, and the idling by contact 22 in a closed circuit.

Figure 3A:
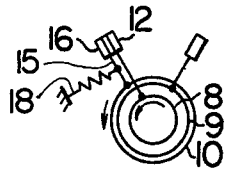
Figure 3B:
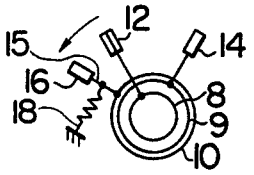
Figure 3C:
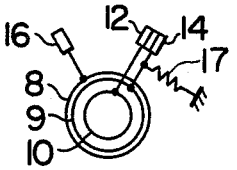

Their functions will be described, referring to FIGS. 3A to 3C. FIG. 3A show the state at the accelerating stage. When the throttle valve is opened at the accelerating stage, shaft 8 is turned. Then, shaft 8 and shaft 10 are turned in arrow directions, while pushing contact 16 in a closed circuit state of contact 12 and contact 16. When the acceleration is completed and the movement of the throttle valve is stopped, the movement of contact 12 is stopped, while shaft 10 is drawn back by the spring, and contacts 16 and 12 are separated from each other, as shown in FIG. 3B. In Figure, spring 18 is fixed to lever 15 for the sake of simplifying the description, but actually the spring is wound around shaft 8, and when the turning of shaft 8 is stopped, shaft 8 is to be a little returned in a direction opposite to the turning direction.

At the slowing-down stage, said functioning is reversed. As shown in FIG. 3C, contact 12 is turned while keeping itself in contact with contact 14, and when the throttle valve is returned, these two contacts are separated from each other by spring 17. That is, the respective contacts are brought in a closed circuit only at the accelerating stage and the slowing-down stage, and the respective contacts are positioned in an open circuit at the steady running stage.

Thus, an output $e_2$ is derived at the steady running stage, an output $e_3$ at the accelerating stage, and an output $e_1$ at the slowing-down or idling stage.

Figure 4:
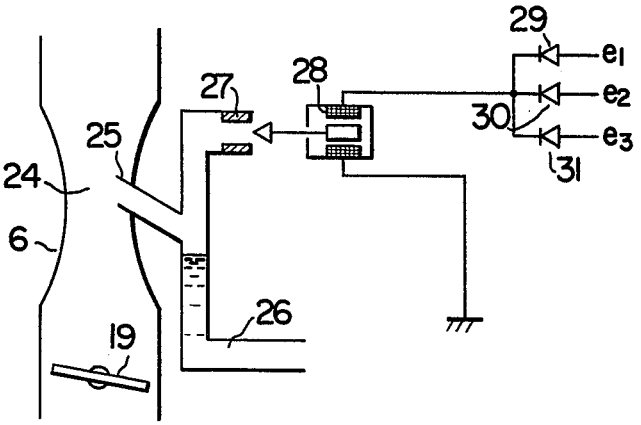

When the outputs $e_1$, $e_2$, and $e_3$ are derived, an air-fuel mixture is controlled according to the manner shown in FIG. 4. That is, in FIG. 4, main nozzle 25 is open to venturi part 24 of carburetor 6, and is communicated with float chamber, not shown in the drawing, through main fuel passage 26. Air bleed 27 is connected to main fuel passage 26 on a way, and introduces air into main fuel passage 26. Proportioning solenoid valve 28 capable of changing a stroke by input values is provided at the open end of air bleed 27, and connected to outputs $e_1$, $e_2$ and $e_3$ of FIG. 2 through diodes 29, 30 and 31, where the outputs $e_1$, $e_2$ and $e_3$ are in a relation of $e_1 > e_2 > e_3$. When the output $e_1$ is derived at the slowing-down and idling stage, the output is given to proportioning solenoid valve 28, but air bleed 27 supplies a large amount of air to main fuel passage 27 owing to large $e_1$, and the air-fuel mixture is diluted thereby. The three-functional catalyst is used in an oxidizing state (zone III).

When the output $e_2$ is derived at the steady running stage, the output is also given to proportioning solenoid valve 28. Proportioning solenoid valve 28 reduces the opening area of air bleed 27 because $e_2$ is less than $e_1$, and consequently reduces the amount of air to be supplied to main fuel passage 27. At that time, the air-fuel mixture is controlled approximately to the theoretical air-fuel ratio, and the three-functional catalyst is used in a three-functional state (zone II).

When the output $e_3$ is derived at the accelerating stage, the output is also given to proportioning solenoid valve 28. Proportioning solenoid valve 28 further reduces the opening area of air bleed 27, because the output $e_3$ is much less than $e_2$, and consequently reduces the amount of air to be supplied to main fuel passage 27. Therefore, the air-fuel mixture is shifted to an enriching direction, and the three-functional catalyst is used in a reducing stage (zone I).

Now, another embodiment of the present invention using an $O_2$ sensor will be described below.

Figure 5:
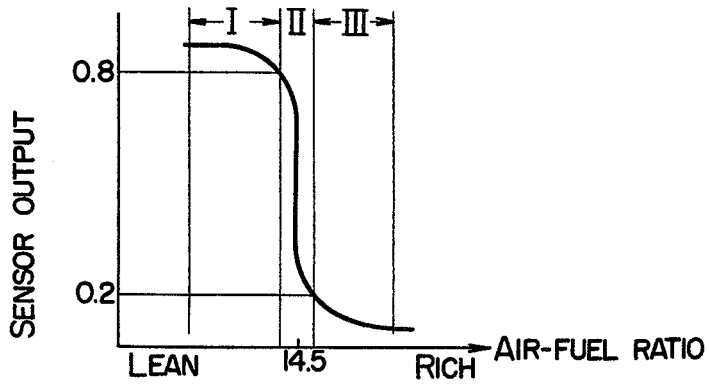
FIG. 5 is a characteristic diagram of $O_2$ sensor showing relations between air-fuel ratio and output of the sensor.

In FIG. 5, an output characteristic of $O_2$ sensor is shown. According to the conventional system, an air-fuel ratio of carburetor is continuously changed to meet the output. Therefore, a function to absorb changes in characteristics of $O_2$ sensors lots by lots or changes in temperature is required for the control circuit, but such function is practically almost impossible in view of its durability, reliability, cost, etc.

According to the embodiment of the present invention, on the other hand, the air-fuel ratio is divided into three zones with respect to the output of $O_2$ sensor, as shown in FIG. 5, that is, zone I for higher than 0.8 V, zone II for 0.8 to 0.2 V, and zone III for lower than 0.2 V.

Figure 6:
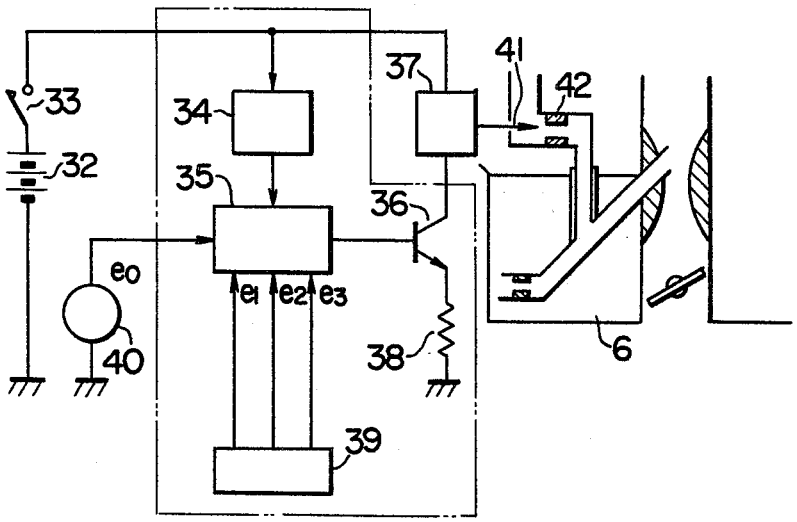
FIGS. 6 and 7 show structures of another apparatus for purifying an exhaust gas, embodying the present invention.

In FIG. 6, a concrete structure of the above embodiment is shown, where numeral 32 is a battery, 33 a key switch, 34 a constant voltage circuit, 35 a function-generating circuit, 36 a power transistor, 37 an electromagnetic valve, 38 a voltage-current conversion resistor, and 39 a reference voltage-generating circuit.

Figure 7:
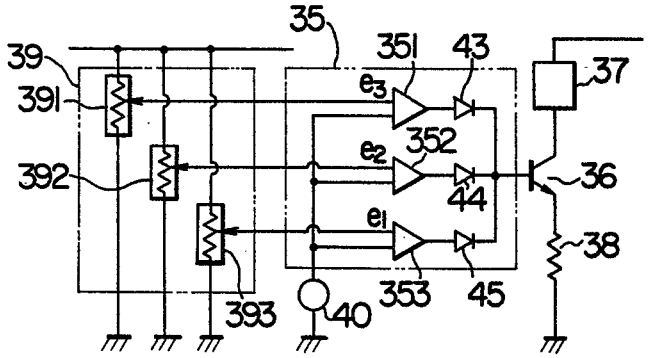

Reference voltage-generating circuit 39 and function-generating circuit 35 are combined together, as shown in FIG. 7, where the reference voltage-generating circuit comprises potentiometers 391, 392 and 393, which generate signals $e_1$, $e_2$ and $e_3$, and the function-generating circuit comprises comparators 351, 352 and 353, and diodes 43, 44 and 45, which compare the outputs of $O_2$ sensor 40 with the outputs of potentiometers 391, 392 and 393, and the compared signals are given to power transistor 36.

Now, three reference voltages, $e_3$, for example, signal of lower than 0.2 V, $e_2$, for example, signal of 0.2 V to 0.8 V, and $e_1$, for example, signal of higher than 0.8 V, are given from reference voltage-generating circuit 39.

When the output $e_0$ of $O_2$ sensor 40 is lower than 0.2 V, it is compared with the signal of the reference voltage, and function-generating circuit 35 works, and electromagnetic valve 37 works to bring the air-fuel ratio of carburetor into zone III. When the output $e_0$ of $O_2$ sensor 40 is between 0.2 V and 0.8 V, electromagnetic valve 37 works to bring the ratio into zone II, and likewise when the output $e_0$ of $O_2$ sensor is higher than 0.8 V, the electromagnetic valve works to bring the ratio into zone I.

Electromagnetic valve 37 has a needle valve 41 which is arranged to be engaged with main air bleed 42 of carburetor 6, and needle valve 41 is moved by the output of $O_2$ sensor 40 to change the opening area of main air bleed 42. When the opening area is increased, the air-fuel mixture is diluted, that is, the air-fuel ratio is decreased. When the opening area is reduced, the air-fuel mixture is enriched, that is, the air-fuel ratio is increased.

Therefore, it is possible to control the air-fuel ratio of carburetor to any of three zones, as shown in FIG. 5, by the output of $O_2$ sensor 40.

As described above, in the present invention, every driving conditions including accelerating, slowing-down, and idling are divided into three zones, and the air-fuel ratio of carburetor is controlled in the respective zones. The control is characterized by providing an enriched air-fuel mixture at the accelerating stage, an air-fuel mixture having approximately the theoretical air-fuel ratio at the steady running stage, and a diluted air-fuel mixture at the slowing-down and idling stage. Further as a control imput means, a switch mechanism for determining said three zones, communicated with a throttle valve, and an adjusting means for making the air-fuel ratio of carburetor suitable for the respective three zones by said switch mechanism are provided in the present invention.

Furthermore, a control means for making the air-fuel ratio of carburetor suitable for the respective three zones by a feedback control making control of the air-fuel ratio of carburetor by a sensor for detecting one component of exhaust gas is provided in the present invention.

According to the present invention, the following significant effects can be expected. Since it is not necessary to control the air-fuel ratio of carburetor to a narrow range around the theoretical air-fuel ratio at every driving conditions, but the driving conditions are divided into three zones and the air-fuel ratio is controlled to be brought into any one of the three zones, no strict precision is required for individual parts constituting the apparatus, and consequently the durability and reliability are increased, providing a stable control system at a lower cost. That is, the present invention can provide a very practical system having a high productivity.

Furthermore, since a feedback control using an $O_2$ sensor detecting one component of exhaust gas is also possible and thus the strict requirement for the responsibility of the system or gain can be eliminated from the system, the system is simplified, the stability and reliability of the system are improved, and a very practical system can be provided at a lower cost.

As a capacity for purifying the exhaust gas, purification of $NO_x$ is given a preference in a driving state by the present control means when the exhaust gas is at a high $NO_x$ concentration, and also oxidation of HC and CO is given a preference when the exhaust gas is at high HC and CO concentration. Thus, the present system is rather rational than the conventional feedback system, and can offer many distinguished effects such as provision of a well balanced system for purifying exhaust gas.

What is claimed is:

1. An apparatus for purifying exhaust gas by a single three-functional catalyst capable of oxidizing hydrocarbons and carbon monoxide and simultaneously reducing nitrogen oxides provided in an exhaust gas line, which comprises a fuel-controlling means for dividing driving conditions into an accelerating stage as zone I, a steady running stage as zone II, and a slowing-down and idling stage as zone III, and controlling an air-fuel mixture to be fed from a carburetor to a reducing state of the three-functional catalyst in zone I, a three-functional state thereof in zone II, and an oxidizing state thereof in zone III.

2. An apparatus according to claim 1, wherein the fuel-controlling means comprises a throttle valve opening detector for detecting three states of throttle valve provided at the carburetor at the accelerating stage, steady running stage, and slowing-down and idling stage, and an electromagnetic valve for changing an amount of air to be passed through a main air bleed of the carburetor by signals of the throttle valve opening detector, and the electromagnetic valve successively reduces the amount of air to be passed through the main air bleed in order of the slowing-down and idling stage, steady running stage and accelerating stage.

3. An apparatus according to claim 1, wherein the fuel-controlling means comprises an $O_2$ sensor provided in the exhaust line, a reference voltage-generating means for generating three kinds of signals, a comparator means for comparing outputs of the $O_2$ sensor with outputs of the reference voltage-generating means, an amplifying means to be functioned by the outputs of the comparator means, and an electromagnetic valve for changing an amount of air to be passed through a main air bleed of carburetor, driven by the amplifying means, and the amount of air to be passed through the main air bleed is controlled to an increasing proportion in order of the accelerating stage to the steady running stage to the slowing-down and idling stage by comparision of outputs of the $O_2$ sensor with the three kinds of signals of the reference voltage-generating means.

* * * * *